US005477586A

United States Patent [19]

Jacobs et al.

[11] Patent Number: 5,477,586

[45] Date of Patent: Dec. 26, 1995

[54] VACUUM CLEANER WITH ACCESSORY SHUTOFF

[75] Inventors: Scott Jacobs, Bloomington; Joyce Thomas, Lexington; Jeffrey W. Smith, Bloomington, all of Ill.

[73] Assignee: White Consolidated Industries, Inc., Cleveland, Ohio

[21] Appl. No.: 276,932

[22] Filed: Jul. 19, 1994

[51] Int. Cl.[6] ..... A47L 5/32

[52] U.S. Cl. ..... 15/332; 15/335

[58] Field of Search ..... 15/331, 332, 333, 15/334, 335, 337

[56] References Cited

U.S. PATENT DOCUMENTS

| | | | |
|---|---|---|---|
| 2,218,035 | 10/1940 | Benson . | |
| 2,416,417 | 2/1947 | Taylor | 15/332 |
| 2,502,674 | 4/1950 | Sellers | 15/332 |
| 2,504,846 | 4/1950 | Kirby | 15/335 |
| 2,517,670 | 8/1950 | Humphrey . | |
| 2,637,874 | 5/1953 | White . | |
| 3,188,681 | 6/1965 | Jepson et al. . | |
| 3,319,282 | 5/1967 | MacFarland . | |
| 3,676,890 | 7/1972 | Dyer . | |
| 3,715,775 | 2/1973 | Nickelson . | |
| 3,879,797 | 4/1975 | Principe et al. . | |
| 4,225,999 | 10/1980 | Martinec et al. . | |
| 4,377,882 | 3/1983 | Dyson . | |
| 4,447,931 | 5/1984 | Lindqvist . | |
| 4,563,790 | 1/1986 | Clark . | |
| 4,686,736 | 8/1987 | Petralia et al. . | |
| 4,776,059 | 10/1988 | Worwag . | |
| 4,811,452 | 3/1989 | Sumerau . | |
| 4,845,793 | 7/1989 | Meyer . | |
| 4,905,343 | 3/1990 | Jailor . | |

*Primary Examiner*—David Scherbel
*Assistant Examiner*—Tony G. Soohoo
*Attorney, Agent, or Firm*—Pearne, Gordon, McCoy & Granger

[57] ABSTRACT

A socket is provided on the upright portion of a vacuum cleaner for the insertion of the wand on the distal end of the accessory hose. The wand, which is normally inserted into the socket when the accessories are not being used, engages a linkage mechanism within the socket. The linkage mechanism closes a valve door within the suction stream when the wand is removed to close the suction passageway from the vacuum source to the base and open the suction passageway to the hose. The linkage mechanism opens the valve door when the wand is replaced to close the suction passageway to the hose and open the suction passageway to the base. The present invention automatically closes the suction passage from the floor engaging portion whenever the accessories are being used and assures that the suction connections are always in the proper position for floor cleaning or above-floor cleaning.

6 Claims, 6 Drawing Sheets

VACUUM CLEANER WITH ACCESSORY SHUTOFF

BACKGROUND OF THE INVENTION

1. Field of the Invention

This invention relates to upright vacuum cleaners and more particularly to upright vacuum cleaners having an auxiliary port for connection of a hose for various above-floor cleaning accessory attachments.

2. Description of the Prior Art

Various designs for upright domestic vacuum cleaners have been known for many years. Such vacuum cleaners typically have a base that rolls on the floor by means of wheels. The base includes a rotating brush roller that includes beater bars and brushes to beat the carpet and loosen dirt so that the dirt can be drawn by vacuum means from the base to a bag or box located on the upright portion of the vacuum cleaner.

Upright vacuum cleaners have also been used for many years with various; accessories for above-floor cleaning of furniture, drapes and other items. These accessories are connected to the vacuum cleaner by means of an accessory hose. The accessory hose is connected to the vacuum cleaner, and the air that is normally drawn from the base is instead drawn through the accessory hose, so that the accessories can clean above-floor surfaces.

More recent designs of vacuum cleaners have included an accessory hose that is mounted on the vacuum at all times. This allows the user to have easy access to the accessories during the performance of house cleaning and permits use of the accessories at any time as needed without repeatedly connecting and disconnecting the accessory hose. Since the hose is intended to be attached to the vacuum at all times, there should be some means for isolating the hose from the vacuum source when the accessories are not being used and for connecting the hose to the vacuum source during above-floor cleaning operations. This is usually accomplished using some sort of switch or lever that the user must engage each time the accessory hose is used.

The switch or lever may be difficult for the user to operate. Furthermore, it is important that the user remember to change the position of the lever when finished with above-floor cleaning and that the user position the lever properly so the floor cleaning can be performed with maximum efficiency. If the lever is not moved to the full position in each direction, the vacuum does not operate properly.

Another problem experienced during the use of the accessories is the operation of the brush roller in the base of the vacuum cleaner. When the user is performing above-floor cleaning using the accessory hose, the brush roller normally continues to rotate. If the base of the vacuum cleaner is positioned in a lowered position adjacent to the carpet, the brush roller continues to rotate at a fixed location on the carpet. The brushes and beater bars in the brush roller can damage the carpet if left in the same location for a long duration. If the above-floor cleaning continues for an extended period of time, the continued rotation of the brush roller in a fixed location can seriously damage the carpet.

SUMMARY OF THE INVENTION

The present invention overcomes the problems of the prior art and provides several advantages in vacuum cleaner design. The vacuum cleaner of the present invention utilizes the vacuum cleaner design in which the accessory hose is intended to be connected to the vacuum cleaner at all times, but the present invention provides an improved means for connecting the hose to the suction source during above-floor cleaning operations and for disconnecting the hose from the suction source during normal floor cleaning.

In accordance with the present invention, a nest or socket is provided on the vacuum cleaner for the insertion of the distal end of the accessory hose. The distal end normally contains a wand that is used for connecting the hose to the accessories or for cleaning in cracks and crevices. This wand is inserted into the socket when the accessories are not being used. A linkage mechanism in the socket closes a valve door within the suction stream when the wand is removed to close the suction passageway from the vacuum source to the base and open the suction passageway to the hose. Similarly, the linkage mechanism opens the valve door when the wand is replaced to close the suction passageway to the hose and open the suction passageway to the base.

The present invention provides an effective means for automatically changing the suction passage from the base to the accessory hose whenever the accessories are being used. In addition, the invention provides an equally effective means for assuring that the suction connections are always in the proper position for floor cleaning or above-floor cleaner by using the removal of the wand from its storage position as the means for positioning the internal valving of the vacuum cleaner.

Using the present invention, the user is assured that the accessory hose will be properly connected to the vacuum source whenever the wand at the end of the hose is removed from its normal storage position. The user is also assured that the vacuum source will be properly connected to the base for floor cleaning when the use of the accessories is completed and the wand is returned to its storage position.

In addition, the present invention includes a connection that automatically stops rotation of the brush roller during above-floor cleaning using the accessories. The internal valving mechanism that is connected to the socket in which the wand is inserted when not in use includes an electrical switch, such as a microswitch, that is connected to the motor that drives the brush roller. When the wand is removed for above-floor cleaning, the brush roller is turned off so that it does not continue to rotate and possibly to damage the carpet. When above-floor cleaning is completed and the wand is returned to its storage position, the switch is engaged to turn the brush roller back on so that effective floor cleaning can continue.

These and other advantages are provided by the present invention of a vacuum cleaner which comprises a floor engaging portion, a housing connected to the floor engaging portion, suction means within the housing, a first passageway connecting the floor engaging portion to the suction means, an accessory hose having a proximate end and a distal end, the accessory hose being connected to the housing at the proximate end, a second passageway connecting the proximate end of the accessory hose to the suction means, means on the housing for engaging the distal end of the accessory hose, and valve means within the housing operatively connected to the engaging means for closing the second passageway and opening the first passageway when the distal end of the accessory hose engages the engaging means.

DETAILED DESCRIPTION OF THE PREFERRED EMBODIMENT

Figure 1:
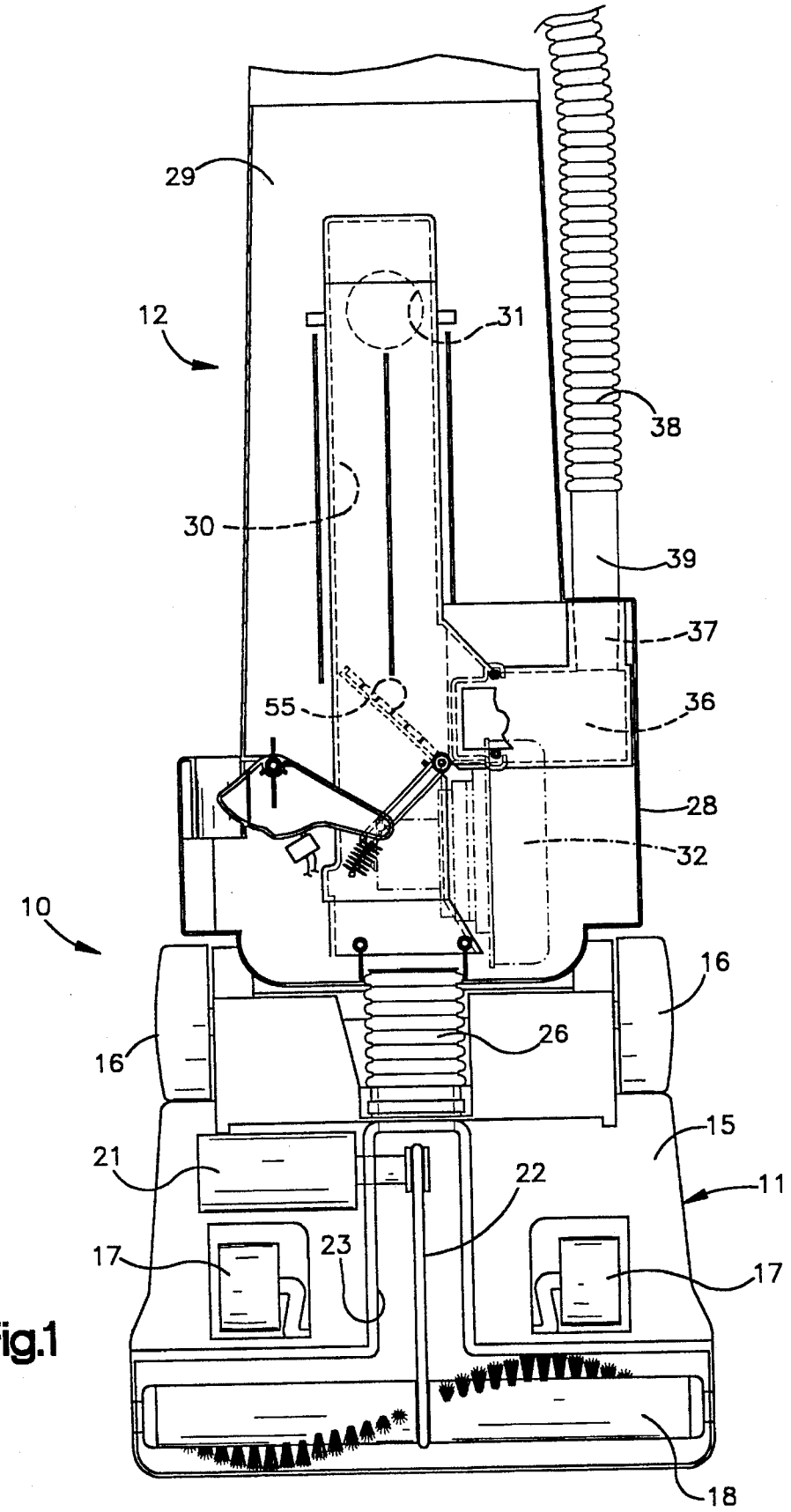
FIG. 1 is a bottom plan view, partially in section, of a vacuum cleaner according to the present invention.

Referring more particularly to the drawings and initially to FIG. 1, there is shown an upright vacuum cleaner 10 in accordance with the present invention. The vacuum cleaner comprises a floor engaging portion or base assembly 11, an upright portion or housing or bag box assembly 12, and a handle assembly (not shown). The handle assembly is connected to the bag box assembly 12 and allows the user to operate the vacuum cleaner in the usual fashion.

The base assembly 11 is shown in FIG. 1. The base assembly 11 includes a body 15 supported by a pair of rear wheels 16 and a pair of front wheels 17 to allow the vacuum cleaner to roll along the floor surface to be cleaned. A rotatable brush roller 18 is mounted in the front of the base assembly 11. The front wheels 17 are vertically adjustable to allow the brush roller 18 to operated at the proper height for the carpet being cleaned.

A motor 21 is mounted in the base assembly 11 and is used to rotate the brush roller 18. The motor 21 is connected to the brush roller by means of a belt 22. The brush roller 18 loosens dirt on the surface in a conventional manner, and the dirt is drawn in an air stream through a passageway 23 created in the middle of the base assembly 11.

The bag box assembly 12 is connected by a hinge arrangement to the base assembly 11 in accordance with typical vacuum cleaner design. Normally, the bag box assembly is generally upright or vertical while the base assembly 11 is horizontal and resting on the floor. Due to the hinge connection between the bag box assembly 12 and the base assembly 11, the bag box assembly can be moved using the handle assembly to any position from fully upright and vertical to a reclined horizontal position to permit the vacuum cleaner to assume a lower profile for cleaning under furniture. In FIG. 1, the bag box assembly 12 is shown in its fully reclined or horizontal position so that the operational relationship between the bag box assembly and the base assembly 11 can be presented more clearly. The passageway 23 in the base assembly 11 through which dirt laden air is conveyed is connected to the bag box assembly 12 by a bellows 26.

The bag box assembly 12 includes a body 28 forming an internal box 29 in which dirt is collected. The box 29 is provided with a removable bag (not shown) which provides a filter for removal of dirt from the air and provides a means for easily removing the dirt. The dirt laden air is conveyed to the bag box 29 through a passageway 30 extending vertically along the rear of the body 28, and enters the bag box through an opening 31. A partial vacuum is created in the box 29 by a motor/fan assembly 32 mounted in the lower portion of the body 28. The motor/fan assembly 32 includes a fan that pulls air from the box 29 and exhausts the air through an exhaust port (not shown). The effect of the motor/fan assembly 32 is to pull filtered air from the box 29, creating a partial vacuum in the box which, in turn, pulls the dirt-laden air into the box from the passageway 30.

Figure 2:
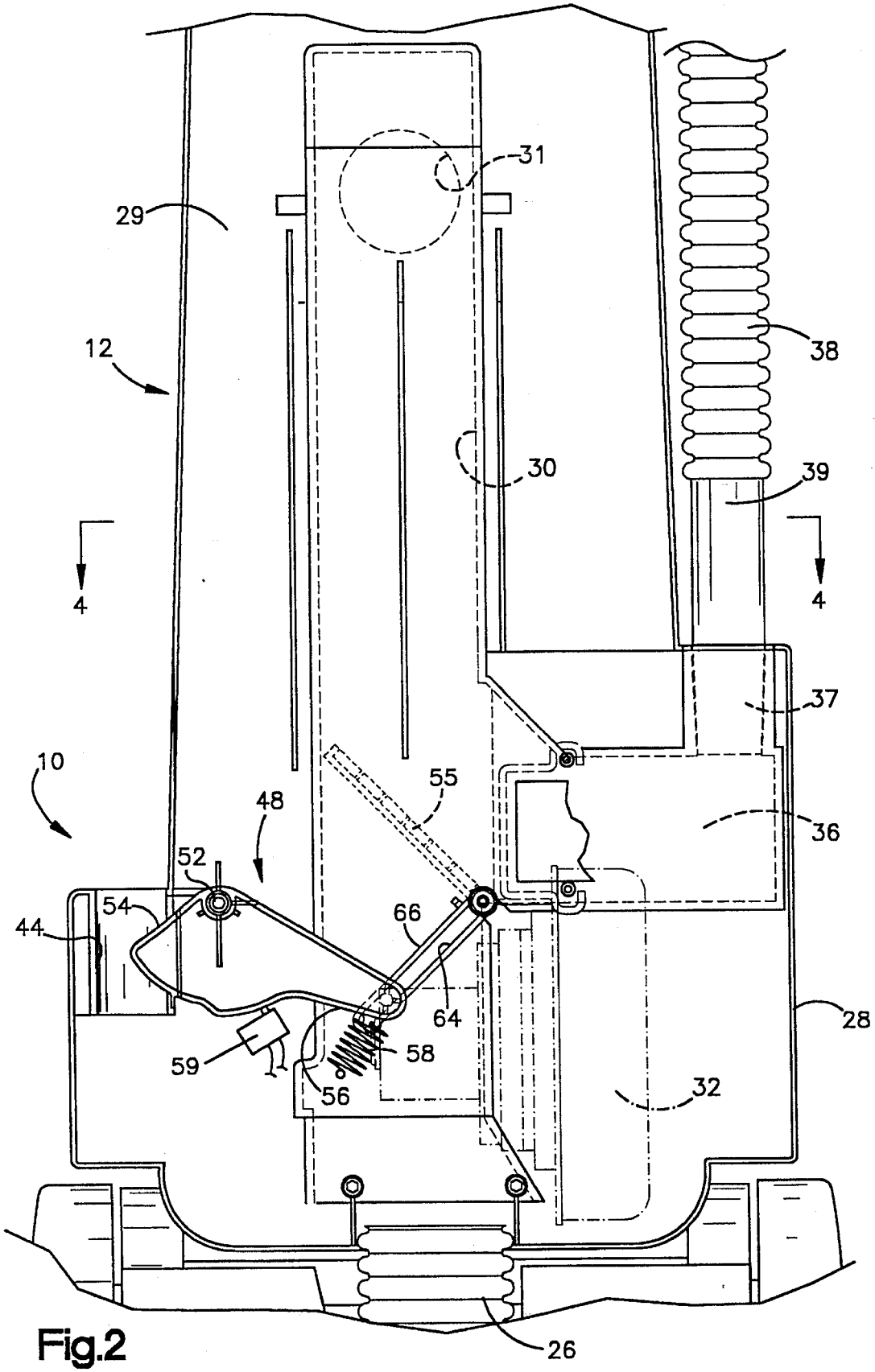
FIG. 2 is a detailed sectional view of a portion of the vacuum cleaner of FIG. 1 with the valve door in its closed position.

The passageway 30 is connected to base assembly 11 by means of the bellows 26 which is attached to the body 28. The passageway 30 is also connected to various accessories that may be used with the vacuum cleaner through a channel 36 which extends laterally from the passageway 30. As shown in FIG. 2, the channel 36 connects the main passageway 30 with a hose coupling 37. An accessory hose 38 is connected at its proximate end 39 to the hose coupling 37. The hose 38 has a wand 40 (FIG. 3) on its other end or distal end, and any of the various accessories may be connected to the wand on the distal end of the accessory hose.

Figure 3:
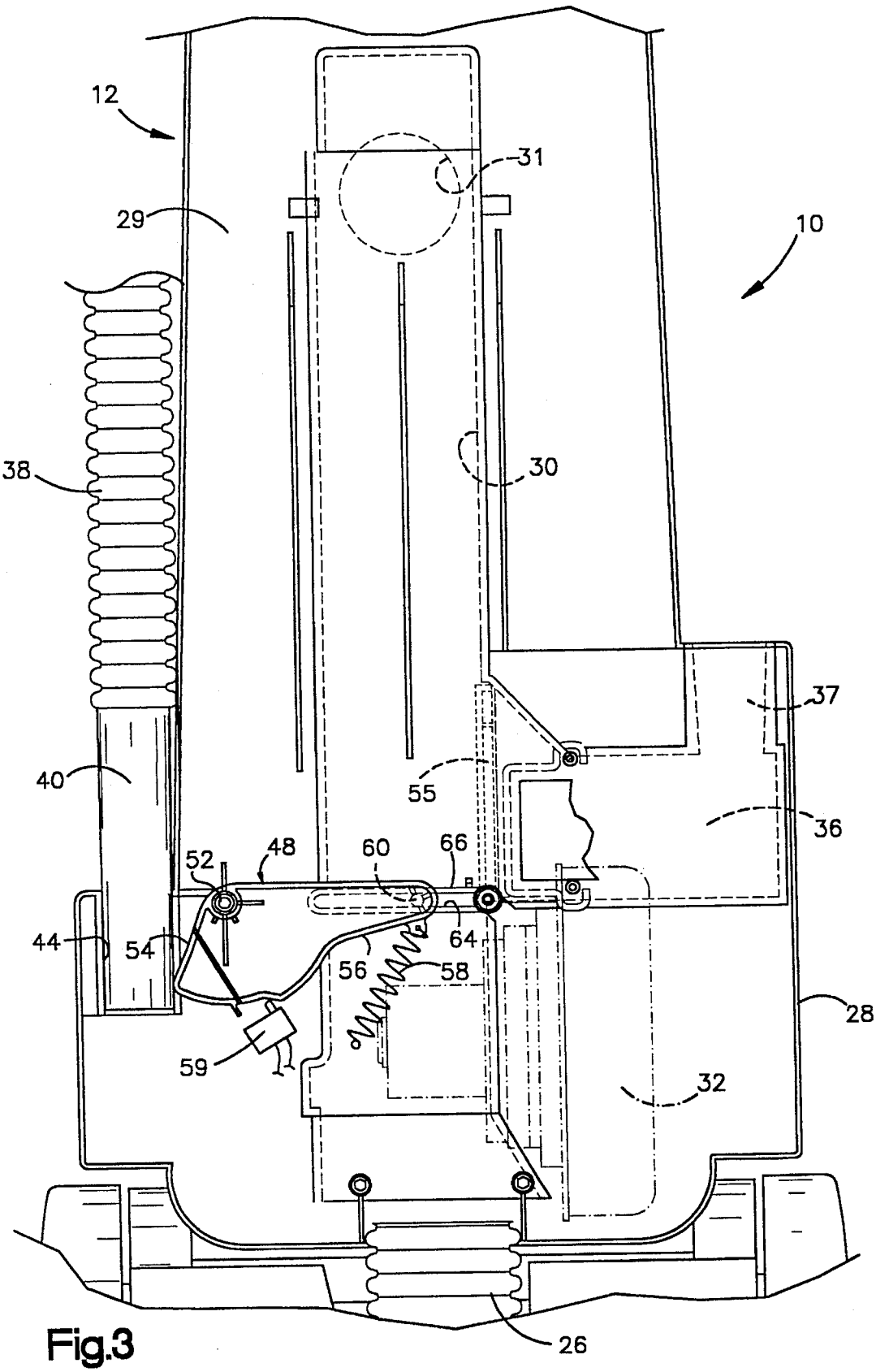
FIG. 3 is a sectional view similar to FIG. 2 showing the valve door in its open position.

When the accessories are not being used, the hose connected to the hose coupling 37 is stored by connecting it to the handle above the bag box assembly 12, so that the accessory wand on the other end of the accessory hose is located on the side of the bag box assembly opposite the hose coupling 37. A storage nest or socket 44 is formed on this side of the bag box assembly 12 into which the wand 40 is inserted when the accessories are not being used (FIG. 3). The wand 40 is inserted downwardly into the vertically extending socket 44. The end of the wand 40 is held snugly within the socket 44 by a wand clip at the base of the socket.

Figure 4:
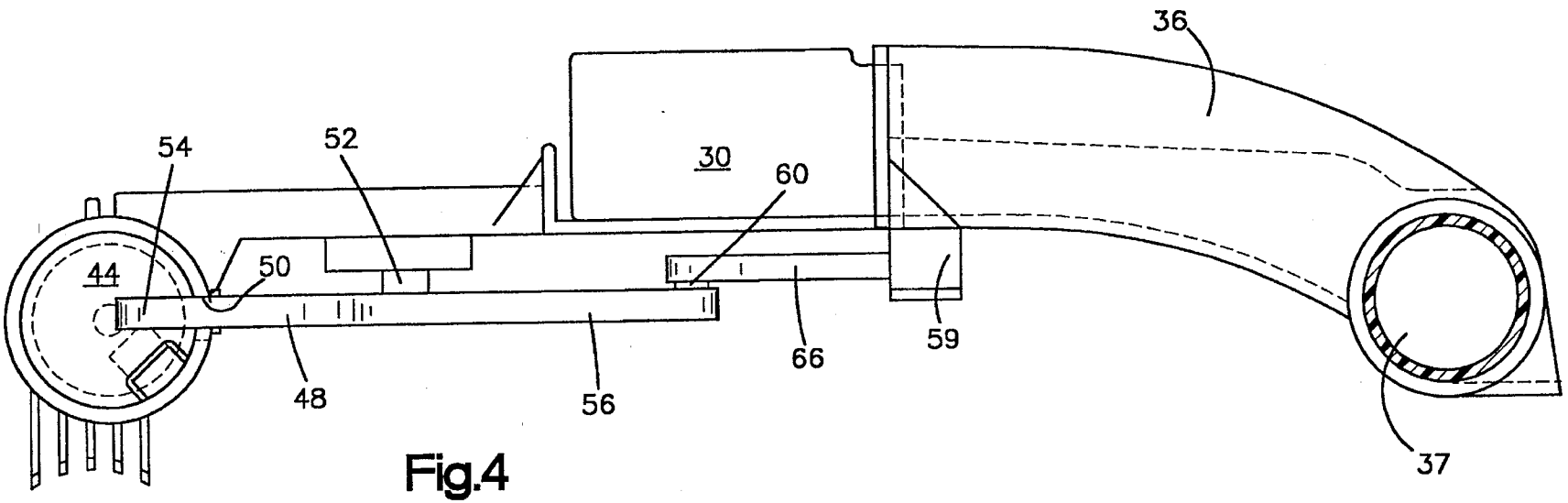
FIG. 4 is a cross sectional view taken along line 4—4 of FIG. 2.

A linkage cam 48 is mounted to project into the socket 44 through a longitudinal slit 50 (FIG. 4) in the socket wall. The cam 48 is mounted on a pivot pin 52 and has a cam surface 54 which is engaged by the wand 40 as the wand is inserted downwardly into the socket. When the cam surface 54 is engaged by downward movement of the wand 40, a linkage cam arm 56 is rotated upwardly to the position illustrated in FIG. 3 against the bias of an extension spring 58. When the wand 40 is removed from the socket 44, the spring 58 pulls the cam arm 56 downwardly to the position illustrated in FIG. 2.

Figure 5:
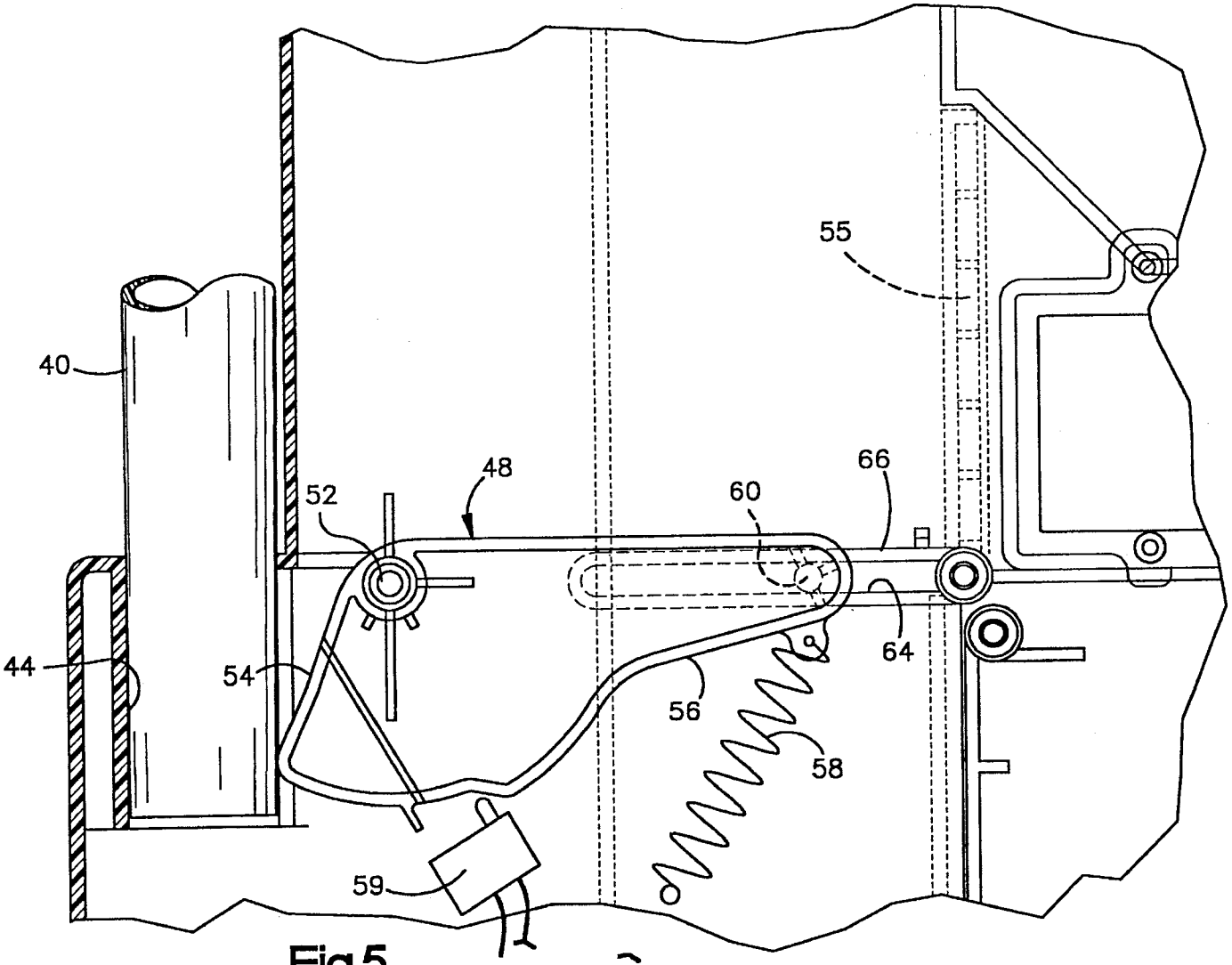
FIG. 5 is an enlarged view of a portion of the apparatus illustrated in FIG. 3.
Figure 6:
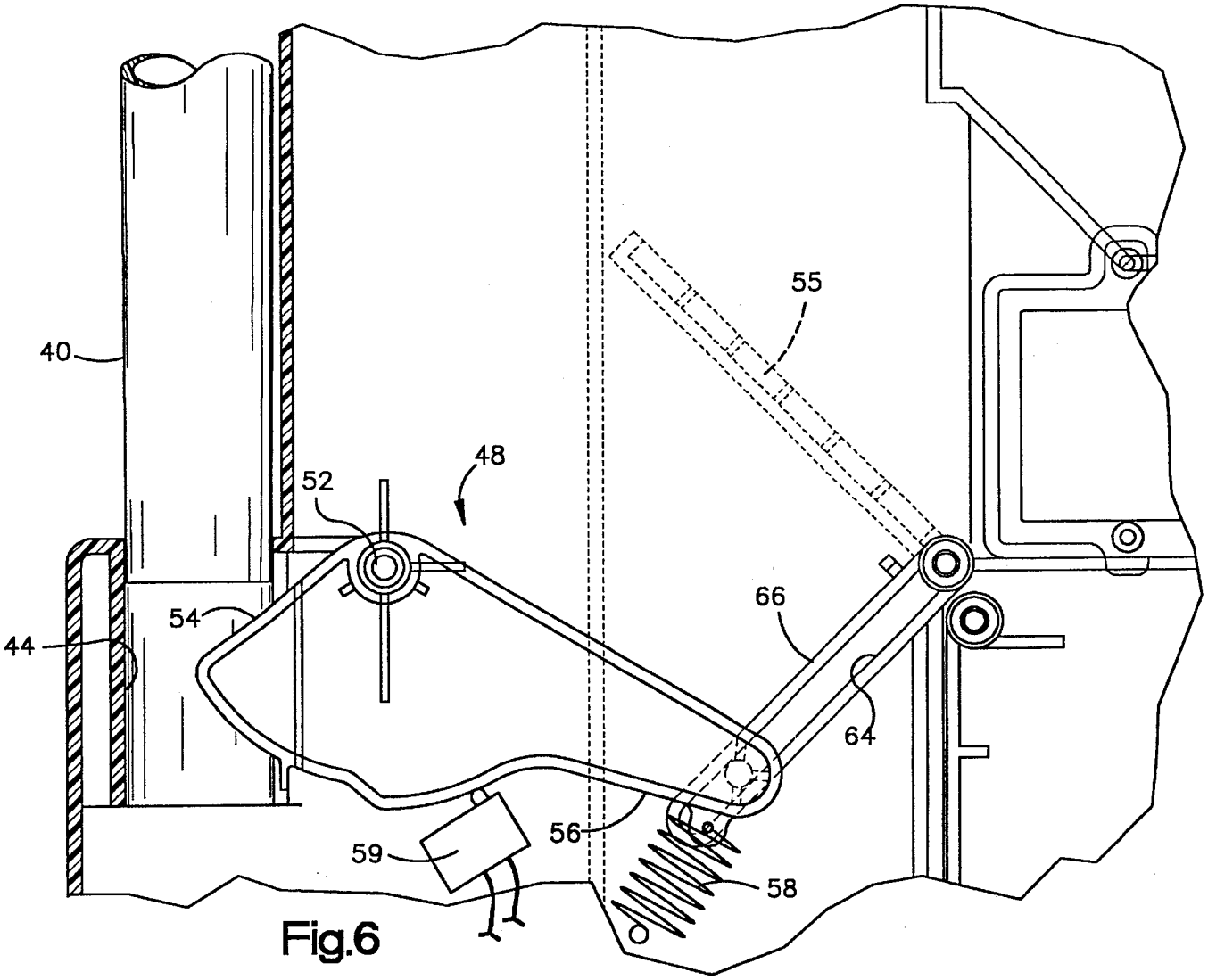
FIG. 6 is an enlarged view of a portion of the apparatus illustrated in FIG. 2.

As may be seen in FIG. 5, the distal end of the arm 56 has a pin 60 projecting therefrom which is pivotally and slidably received in a channel slot 64 in a linkage crank arm 66. The crank arm 66 is fixed to a valve door 55, and both the door 55 and the crank arm 66 are pivotally connected to the body 28.

Referring again to FIG. 3, as the wand 40 is inserted in the socket 44, the cam arm 56 moves upwardly, and the head 62 of the pin 60 pivots and slides in the channel 64 until the crank arm 66 rotates the door 55 against the bias of the spring 58 connected to the crank arm to a position where the door 55 isolates the channel 36 from the passageway 30, so that little or no air flow is pulled through the accessory hose. At the same time, the connection between the passageway and the bellows 26 is open. Also, when the door 55 closes the channel 36 from the passageway 30, the cam 48 releases a plunger of a switch 59, which may be a microswitch, such as those typically used as limit switches. The switch 59 is connected in series to the power supply to the base motor so that the base motor 21 is turned off unless the cam 48 releases the plunger.

Referring to FIG. 2, when the wand 40 is removed from the socket, the door 55 closes the passageway 30 from its connection to the bellows, restricting the flow of dirt-laden air from the base assembly. At the same time, the connection between the passageway 30 and the channel 36 is open, allowing air to be drawn from the accessory hose. Also, the power connection to the base motor is turned off since the plunger of the switch 59 is engaged.

During normal floor cleaning, the wand 40 on the end of the accessory hose 38 is inserted in the storage socket 44, as shown in FIG. 3, urging the cam arm 56 upwardly in opposition to the spring 58. The position of the cam arm 56 keeps the crank arm 66 in its upward position, maintaining the door 55 in a position closing the channel 36 and opening the flow of dirt-laden air from the connecting hose 26 to the passageway 30. With the door 55 in that position, dirt-laden air is pulled from the base assembly 11 through the passageway the bellows 26 and the passageway 30 into the box 29 by the action of the motor/fan assembly 32.

When the user desires to perform above-floor cleaning operations using any of the accessories, the user removes the wand 40 on the end of the accessory hose 38 from the storage socket 44. With the removal of the wand 40 (FIG. 2), the cam arm 56 and the crank arm 66 are pulled downwardly by the extension spring 58, causing the valve door 55 to close the passageway 30, so that the suction of the motor/fan assembly 32 no longer pulls air from the base assembly 11. At the same time, the channel 36 to the hose connection is opened, allowing the suction to pull air from the accessory hose 38. In this position, the cam 48 engages the switch 59 which turns the base motor 21 off, so that the brush roller 18 does not rotate unnecessarily while above-floor cleaning is taking place.

The present invention thus provides an effective means for automatically closing the suction passage from the base assembly 11 whenever the accessories are being used and for assuring that the function connections are always in the proper position for floor cleaning or above-floor cleaning. The accessory hose 38 will be properly connected to the vacuum source whenever the wand 40 at the end of the hose is removed from its normal storage position, and the vacuum source will be properly connected to the base assembly 11 for floor cleaning when the use of the accessories is completed and the wand is returned to its storage position. In addition, the switch 59 and its connection with the motor 21 automatically stops rotation of the brush roller 18 during above-floor cleaning using the accessories, so that the brush roller does not continue to rotate and possibly to damage the carpet.

While the invention has been shown and described with respect to a particular embodiment thereof, this is for the purpose of illustration rather than limitation, and other variations and modifications of the specific embodiment herein shown and described will be apparent to those skilled in the art all within the intended spirit and scope of the invention. Accordingly, the patent is not to be limited in scope and effect to the specific embodiment herein shown and described nor in any other way is this inconsistent with the extent to which the progress in the art has been advanced by the invention.

What is claimed is:

1. A vacuum cleaner which comprises:

a floor engaging portion for resting on a floor;

a housing connected to the floor engaging portion; suction means within the housing;

conduit means defining a first passageway having at least a portion within said housing, said first passageway connecting the floor engaging portion to the suction means;

an accessory hose having a proximate end and a distal end, the accessory hose being connected to the housing at the proximate end;

said conduit means further defining a second passageway within the housing connecting the proximate end of the accessory hose to the suction means;

engaging means on the housing for engaging the distal end of the accessory hose;

a suction chamber defined by and between said housing and said conduit means within said housing;

valve means within the housing having a linkage mechanism in said suction chamber operatively connected to the engaging means, said valve means including a valve door within said conduit means and operably connected to said linkage mechanism for closing the second passageway and opening the first passageway when the distal end of the accessory hose engages the engaging means, and for opening the second passageway and closing the first passageway when the distal end of the accessory hose is disengaged from the engaging means; and filter means between said conduit means and said suction chamber to collect dirt.

2. A vacuum cleaner as defined in claim 1, wherein the floor engaging portion includes a rotating brush roller, comprising in addition switch means associated with the valve means for stopping rotation of the brush roller when the first passageway is closed.

3. A vacuum cleaner as defined in claim 1, wherein the valve means includes a crank arm which moves when the distal end of the accessory hose engages the engaging means, and said engaging means includes a linkage cam arm having a pin which pivotally and slidably engages the crank arm.

4. A vacuum cleaner as defined in claim 3, wherein the engaging means further include a cam surface engageable by the distal end of said accessory hose.

5. A vacuum cleaner which comprises:

a base assembly for resting on a floor;

an upright portion supported on the base assembly;

suction means within the upright portion;

conduit means defining a first passageway having a portion within the upright portion, said first passageway connecting the base assembly to the suction means;

an accessory hose having a proximate end and a distal end, the accessory hose being connected to the upright portion at the proximate end;

said conduit means further defining a second passageway within the housing connecting the proximate end of the accessory hose to the suction means;

means on the upright portion for storing the distal end of the accessory hose when not in use a suction chamber defined by and between said upright portion and said conduit means within said housing;

valve means within the upright portion having a linkage mechanism in said suction chamber operatively connected to the storage means, said valve means including a valve door within said conduit means and operably connected to said linkage mechanism for closing the second passageway and opening the first passageway when the distal end of the accessory hose is stored in the storing means and not in use, and for opening the second passage and closing the first passageway when the distal end of the accessory hose is removed from the storing means and capable of being used; and filter means between said conduit means and said suction chamber to collect dirt.

6. A vacuum cleaner as defined in claim 5, comprising in addition a rotating brush roller in the base portion, a motor in the base portion connected to drive the brush roller, switch means in the upright portion associated with the valve means for stopping the motor and stopping rotation of the brush roller when the first passageway is closed.

* * * * *